United States Patent [19]

Aumann

[11] 4,391,328

[45] Jul. 5, 1983

[54] DRILL STRING SAFETY VALVE

[75] Inventor: James T. Aumann, Salt Lake City, Utah

[73] Assignee: Christensen, Inc., Salt Lake City, Utah

[21] Appl. No.: 265,716

[22] Filed: May 20, 1981

[51] Int. Cl.[3] ..... E21B 34/08

[52] U.S. Cl. ..... 166/325; 166/321; 175/318

[58] Field of Search ..... 166/321, 324, 325; 137/498, 517; 175/232, 243, 317, 318

[56] References Cited

U.S. PATENT DOCUMENTS

| | | | |
|---|---|---|---|
| 2,578,818 | 12/1951 | Martin | 166/325 |
| 3,116,752 | 1/1964 | Duncan | 137/517 |
| 3,122,162 | 2/1964 | Sands | 137/498 |
| 3,385,370 | 5/1968 | Knox et al. | 166/325 |
| 3,719,401 | 3/1973 | Peruglia | 137/517 |
| 3,845,784 | 9/1974 | Sullivan | 137/515 |
| 3,861,414 | 1/1975 | Peterson | 137/512.3 |
| 3,902,523 | 9/1975 | Gaut | 166/321 |
| 3,990,420 | 11/1976 | Bittermann et al. | 137/517 |
| 4,270,569 | 6/1981 | Reay et al. | 166/325 |

FOREIGN PATENT DOCUMENTS

| | | | |
|---|---|---|---|
| 1058477 | 7/1979 | Canada | 137/34 |

*Primary Examiner*—William F. Pate, III
*Assistant Examiner*—William P. Neader
*Attorney, Agent, or Firm*—Walter Fred

[57] ABSTRACT

A multi position safety valve retainable within an internal portion of a drill string casing (s) and responsive to the greater differential pressure in an internal fluid passage to displace a valve head (32) relative to a valve seat (VS) from its normal partially open position to either a wide open or a closed position. The valve head (32) is attached to a valve stem (30) that extends through a valve chamber and slideably mounted in opposite closed ends of a valve body and returnable to and maintained in the partially open position by opposing compression springs (34) (36) situated between opposite ends (22) of the valve body (VB) and one side of an intermediate abutment (30*c*) of the valve stem (30) and an intervening disc (38) on the opposite side thereof. The disc 38 is moveable into and out of seating engagement with an intermediate stop (20*a*) by one spring (34) and the intermediate abutment (30*c*) of the valve stem respectively.

6 Claims, 4 Drawing Figures

FIG. 1
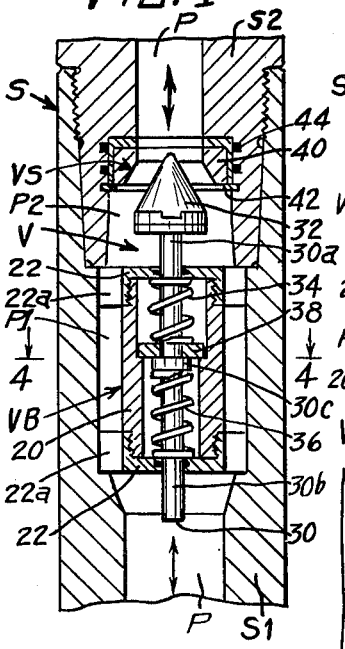
FIG. 2
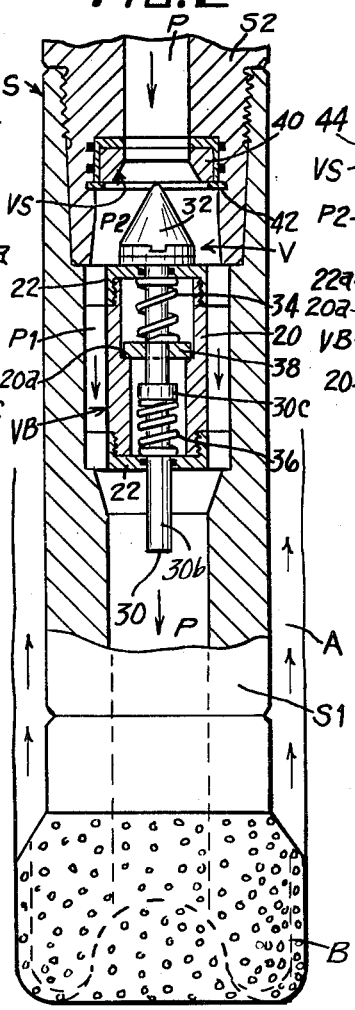
FIG. 3
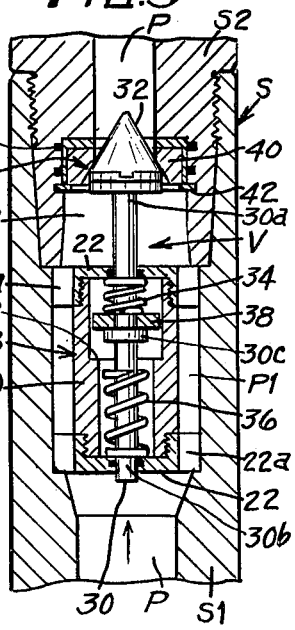
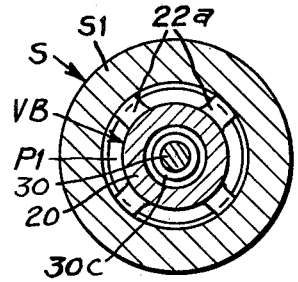
FIG. 4

DRILL STRING SAFETY VALVE

BACKGROUND OF THE INVENTION

1. Field of Invention

The invention relates to a fluid pressure actuated safety valve for allowing normal controlled flow and prohibiting abnormal uncontrolled back flow of fluid pressure through a drill string.

2. Description of the Prior Art

Safety float valves are used to prevent plugging of the drill bit nozzle by the cuttings during trips into the bore hole, to prevent back flow during connection of drill string components, and to eliminate the need for a mud pill when tripping out since the driller can "shake down" the mud in the drill pipe. Float valves are commercially available as a completely sealed or a controlled leakage type valve such as a flapper valve with a small hole therein. The controlled leakage type valve allows for slow control fill up of the drill pipe and enables accurate drill pipe pressure measurement to be taken during a kick or blowout. These float valves are sometimes used as drill string blow-out preventers or safety valves but are not generally reliable because of rapid damage and erosion by the drilling fluid.

Drop in check type safety valves which permit flow of fluid in one direction only are also available and used to prevent back-flow and blow outs. Usually the check valve tool is stored and installed in the drill string only when a kick occurs and therefore are not subject to deterioration or erosion and abuse by the drilling fluid. However, there is the danger during high stress, such as a kick, that the drilling personnel might install the tool containing the check valve upside-down or improperly to resist existing back flow conditions. Also, during an emergency and confusion personnel may not realize that other tools previously installed in the drill string may need to be removed before the check valve tool could be installed in the drill string. Another drill string safety float valve disclosed in Canadian Pat. No. 1,058,477 has, unlike the applicant's, means for delaying the closing of the valve and prohibiting back flow through the drill pipe of any abnormally pressurized fluids.

The applicant's three position downhole safety float valve provides operational and safety advantages over the conventional float and drop in check valves. The valve is installed and remains in the drill string to automatically shut in the well if proper action is not taken by personnel at the surface during a kick. In its normal partially open position the valve permits controlled fill up and drainage of the drill pipe while tripping into and out of the bore hole. When displaced by fluid under pump pressure to its fully opened position the relationship of the valve seat to the displaced valve stem is such as to minimize erosion thereof by the drilling mud during normal drilling operations. In the event of uncontrolled back flow up the drill pipe in excess of the present amount of differential fluid pressure applied thereto, the valve shifts rapidly to its closed position where it prohibits the up flow of fluid therethrough.

SUMMARY OF THE INVENTION

A three position fluid pressure responsive down hole safety valve adapted for mounting in and controlling the flow of fluid through the internal passage of a drill string pipe or casing situated in the bore hole.

The safety valve comprises a valve body including end caps axially retained and centralized within an enlarged portion of the internal passage and surrounding wall of a lower section of the drill string. Angularly spaced fingers extend radially between the end caps and the surrounding wall to provide a fluid passage around the valve body clamped between axially spaced annular shoulders of the lower and an attached adjoining upper section of the drill string casing. The upper section has an internal fluid passage and valve seat therein engageable by the mating surface of a valve head attached to and moveable with a valve stem slideably mounted in the end caps and valve body.

Within the valve body is a sealed chamber divided into a large upper bore and a smaller lower bore by an intermediate surface or shoulder normally engaged by a collar slideably mounted in the large bore and about the valve stem for engaging and compressing an upper return spring surrounding an upper portion of the valve stem.

The valve stem has an enlarged intermediate portion including an upper shoulder for engaging and displacing the collar to compress the spring and a lower shoulder for engaging and compressing a return spring surrounding a lower portion of the valve stem in the lower smaller bore of the valve chamber. The opposing upper and lower return springs act against the opposite end caps of the valve body and the intermediate portion to maintain the valve stem and hence the attached valve head in a normal substantially counter balanced intermediate partially opened position allowing fluid to pass through the drill string when tripping into and out of the bore hole.

Once in the bore hole the additional downward force of drilling fluid circulated under pump pressure downstream through the drill string and upstream in the surrounding bore hole annulus acts against the valve head to overcome the resistance of and compress the lower return spring and displace the valve head to a full open position.

Any abnormal or greater amount of opposing differential back pressure of fluid acts in conjunction with the lower return spring, upwardly against areas of the valve stem and under-side of the valve head to overcome the opposing lesser differential downward fluid pressure against the valve head and resistance of the upper return spring to compress the upper return spring and close the valve to the back flow of fluid therethrough.

BRIEF DESCRIPTION OF THE DRAWING

FIG. 1 is a sectional view of a portion of a drill string and safety valve of the invention therein shown in its normal partially open position;

FIG. 2 is a sectional view of a portion of a drill string and the safety valve of the invention therein shown displaced to the full open position by fluid circulated downwardly through the drill string and passages in the drill bit into and upwardly in the borehole annulus by the conventional surface pumps;

FIG. 3 is a sectional view of a portion of the drill string and safety valve of the invention therein shown displaced to the closed position in response to back flow of fluid under abnormal greater differential pressure; and FIG. 4 is a cross sectional view through the drill string and safety valve taken on line 4—4 of FIG. 1 showing the configuration of the valve body and the attached end cap with attached spacers providing a fluid passage between the valve body and the wall of the drill string pipe.

DESCRIPTION OF THE PREFERRED EMBODIMENT(S)

In the drawing is shown a multiple or three position downhole safety valve V mounted within a connecting portion of a drill string casing S and adapted to allow flow of fluid under normal pressure and prevent back flow of fluid under abnormal excess pressure through the internal passage P of the drill string S. The portion of the drill string S in which the valve V is retained comprises an upper end portion of a lower tubular sub or section of drill pipe S1 and a lower tapered end portion of an upper tubular sub or section of drill pipe S2 threaded into a mating tapered bore in the upper end portion of the lower sub S1.

Adjoining the tapered bore in the lower section S1 is a large chamber, bore or enlarged portion P1 of the passage P in which the valve body VB of the safety valve V is inserted and retained against axial movement by the engaging lower end of the upper sub S2 and a bottom shoulder or recessed radial surface of the enlarged portion P1 adjoining the passage P. In the lower end portion of the sub S2 is a second smaller chamber, bore or enlarged portion P2 of the passage P into which a valve seat VS is inserted and sealingly retained by suitable means.

The safety valve V comprises the valve body VB including a cylinder 20 and an internal sealed chamber divided by intermediate stop means 20*a* extending inwardly from the side wall. The stop means may comprise an expandable snap ring, recessed shoulder or radial surface situated between an upper or large upper bore and an adjoining lower or smaller lower bore enclosed and sealed off by upper and lower end caps 22 attached to opposite ends of the cylinder 20.

Each of the end caps 22 threaded to the cylinder body 20 has angularly spaced projections or spacers 22*a* with fluid passages therebetween extending radially into engagement with the internal surface of lower sub S1 side wall surrounding the enlarged fluid passage P1 and the valve body VB spaced therefrom.

The end caps 22 have axially aligned and spaced central bores and continuous O-ring like seals in which is slideably mounted and sealingly engaged a valve stem or shaft 30 extending through the internal chamber of the valve body VB.

The valve stem or shaft 30 has an upper flanged portion 30*a* and a lower end portion 30*b* separated by an enlarged intermediate abutment portion or collar 30*c* fixed to and moveable therewith.

Attached to the upper flange end portion 30*a* is a removeable and replaceble valve head 32 constructed preferably of a tapered or cone-shaped piece of suitable wear and erosion resistant material such as tungsten carbide keyed and brazed to a backing member attached by screws or other suitable means to the flanged end portion 30*a*. The conical or cone shape valve head 32 has a smooth outer tapered surface adapted for mating sealing engagement with the internal smooth mating tapered surface about the conical bore in the valve seat VS. Compressible biasing means such as a pair of axially spaced upper and lower compression return springs 34 and 36 are provided for returning and maintaining the valve stem 30 and attached valve head 32 in a normal partialy open position relative to the valve seat VS in the absence of differential fluid pressure across the valve.

The upper helical spring 34 surrounds the upper end portion 30*a* of the valve stem and extends axially in the large upper bore between the upper end cap 22 and a large movable collar or washer 38 extending around the valve stem and biased to seat against the annular stop shoulder or recess surface of the body between the adjoining upper large bore and smaller lower bore of the internal chamger.

The lower helical return spring 36 situated in the smaller lower bore and surrounding the lower valve stem portion 30*b* extends between the lower end cap 22 and the intermediate abutment or collar portion 30*c* biased thereby into engagement with the larger washer or disc 38.

The valve seat VS is preferably a composite comprising an internal valve seat insert 40 including the internal tapered or conical shape bore and surface adapted for mating sealing engagement with the cone valve head 32. Preferably, the internal valve seat insert 40 is constructed of a suitable wear and erosion resistant material such as tungsten carbide inserted into and brazed to an outer metal liner or cup shape casing.

The composite valve seat VS is retained in the enlarged portion PS of the internal passage P of the upper sub S2 by retaining means such as a snap ring 42 inserted and expanded into an internal groove in the lower end portion of the upper sub S2.

If necessary seal means such as a pair of axially spaced continuous O-ring seals 44 shown may be provided for surrounding the valve seat VS and preventing leakage of fluid under pressure therebetween.

Referring to FIG. 1 the valve head 32 is in the absence of differential pressure applied thereto maintained in the normal partially open position shown by the opposing downward force exerted by the slightly compressed upper return spring 34 against the seated washer 38 and the upward force exerted by the slightly compressed spring 36.

The return spring 36 exerts a force sufficiently to raise the valve head 32 and place the intermediate portion 30C of the valve stem 30 into engagement with but insufficient to raise the large washer 38, further compress and overcome the force exerted by the spring 34.

Also, the cross section area on each opposite side of the valve head and stem is substantially equal and available to respond to fluid pressure applied thereto. Thus, equal fluid pressure simultaneously applied to the opposite sides of equal cross sectional surface area would counter balance one another and maintain the valve in the partially open position shown.

This is essentially what happens when tripping the drill string and safety valve V therein into and out of the bore hole at the usual and normal slow rate of descent and ascent. The fluid in the drill string is applied to both sides of the valve head which remains in a partially open position. However, when a differential pressure of fluid occurs across the valve or for example, a greater downward or downstream pressure due to pumps circulating drilling fluid downwardly through the passage P, drill bit B and upwardly in the bore hole annulus A, the valve head 32 is displaced toward the full open position shown in FIG. 2. Displacing of the valve head 32 to the full open position shifts valve stem 30 and intermediate collar portion 30C away from the disc 38 and compresses the lower return spring 36 further. Upon removal of the differential pump pressure the energy stored in the compressed spring 36 is instantly released to return the valve head 32 to the normal partially open position shown in FIG. 1.

The safety valve V is especially useful in that it will respond instantly to shut off back flow or reverse upstream flow of fluid under excess pressure up through the internal passage P.

For example, the valve V will respond and move to the closed position shown in FIG. 3 when a differential fluid pressure exists across the valve head 32 that is greater than the opposing downward pressure of the fluid applied to the opposite upper cross-sectional surface area of the valve head 32.

Excess back pressure of fluid below the valve can result from what is known as a kick which is the sudden release of a subterrian deposit of fluid or liquid under tremendous pressure encountered during the drilling operation. As a result the fluid in the drill string passage P is placed under tremendous abnormal pressure and if the proper action isn't taken can cause a blowout and damage to the components of the drill string and drill rig apparatus at the surface.

The sudden release upward of fluid pressure from below or downstream side of the valve head 32 acts to overcome the lower differential downward fluid pressure applied above or on the upstream side of the valve head and with the help of the compressed spring 36 shifts the valve head 32 into sealing engagement with the valve seat VS.

Upward displacement of the valve head 32 shifts the valve stem and collar 30C thereon into engagement with the washer 38 also displaced thereby and compressing the upper return spring 34. Once the fluid pressure from below subsides and returns to normal the upper return spring 34 will return the valve head 32 to the partially open position and any additional greater downward differential fluid pressure applied thereto by the surface pump will displace it further toward or to the full open position to resume the drilling operation.

As many embodiments of the invention are possible it is to be understood that the invention includes all embodiments, modifications and equivalents falling within the scope of the appended claims.

I claim:

1. A safety valve for allowing controlled normal flow and preventing uncontrolled abnormal back flow of fluid pressure through an internal passage of a drill string casing comprising:

a valve seat situated in and around a portion of the internal passage in a portion of the drill string casing;

a valve body retained within an adjoining portion of the internal passage in the drill string casing and adapted to allow fluid to pass around and through the internal passage comprising a cylinder including an outer sidewall and an internal chamber within the outer side wall extending between opposite ends of the cylinder, and closure means attached to and closing off opposite ends of the cylinder and internal chamber;

a movable valve stem including opposite end portions each slideably mounted in an aperature extending through each of the closure means of the valve body;

a valve head attached to an opposite end portion of the valve stem, adapted for sealing engagement with the valve seat and normally maintained in a partially open position relative to the valve seat sufficient to allow passage of fluid and suspended cuttings during tripping of the drill string casing into and out of the borehole, but displacable to a wide open position in response to a predetermined normal amount of differential fluid pressure in the internal passage directed downstream against one side of the valve head and movable into sealing mating engagement with the valve seat in response to a predetermined abnormal amount of differential fluid back pressure in the internal passage directed back upstream against an opposite side of the valve head; and biasing means of predetermined opposing force comprising abutment means projecting from an intermediate portion of the movable valve stem within the internal chamber, and resilient means extending about each of the opposite end portions of the valve stem and compressible between each of the closure means and the abutment means on and movable with the valve stem for opposing movement of, returning and maintaining the valve stem in a predetermined normal position and the attached valve head in the partially open position in absence of and until the predetermined amount of differential fluid pressure directed against one side of the valve head is sufficiently greater than the opposing force of the resilient means and any fluid pressure directed against an opposite side of the valve head and thereby displace the valve head from the partially open position toward either the wide open position or a closed position.

2. A safety valve according to claim 1 wherein the resilient means comprises:

a pair of helical compression springs extending about opposite end portions of valve stem situated on opposite sides of the abutment means on the intermediate portion of the movable valve stem.

3. A safety valve according to claim 2 further comprising:

stop means extending inwardly into the internal chamber from an intermediate portion of the outer sidewall of the cylinder, and a moveable disc slideable in a portion of the internal chamber adjoining the stop means and around a portion of the valve stem between the abutment means and a compression spring whereby the disc is normally biased toward engagement with the abutment means and the stop means and moveable out of engagement with the stop means by movement toward the valve seat of the valve head, the valve stem and the abutment means in response to a predetermined amount of differential fluid back pressure in the internal passage sufficient to overcome the opposing force and compress the spring.

4. A safety valve according to claim 3 wherein the valve seat comprises a removeable valve seat insert including a conical internal valve seat and bore, and wherein the valve head comprises:

a conical external surface for mating sealing engagement with the conical internal valve seat.

5. A safety valve according to claim 4 further comprising:

removeable retainer means for removing and retaining the removable valve seat insert in and around a portion of the internal passage in a portion of the drill string casing, and seal means extending between and in sealing engagement with the adjacent surfaces of the drill string casing and the removable valve seat insert.

6. A safety valve according to claim 5 further comprising:

spacer means angularly spaced around and extending radially between the valve body and an adjacent wall portion of the drill string casing and continuous seals extending around between the closure means and the end portions of the valve stem.

* * * * *